US010764704B2

(12) United States Patent
Seldess

(10) Patent No.: US 10,764,704 B2
(45) Date of Patent: Sep. 1, 2020

(54) MULTI-CHANNEL SUBBAND SPATIAL PROCESSING FOR LOUDSPEAKERS

(71) Applicant: Boomcloud 360, Inc., Encinitas, CA (US)

(72) Inventor: Zachary Seldess, San Diego, CA (US)

(73) Assignee: Boomcloud 360, Inc., Encinitas, CA (US)

( * ) Notice: Subject to any disclaimer, the term of this patent is extended or adjusted under 35 U.S.C. 154(b) by 83 days.

(21) Appl. No.: 15/933,207

(22) Filed: Mar. 22, 2018

(65) Prior Publication Data

US 2019/0297447 A1 Sep. 26, 2019

(51) Int. Cl.

*H04S 7/00* (2006.01)
*H04R 3/14* (2006.01)
*H04S 3/00* (2006.01)

(52) U.S. Cl.

CPC ..... *H04S 7/303* (2013.01); *H04R 3/14* (2013.01); *H04S 3/008* (2013.01); *H04S 2400/01* (2013.01); *H04S 2400/13* (2013.01); *H04S 2420/07* (2013.01)

(58) Field of Classification Search

CPC ..... H04S 7/303; H04S 3/008; H04R 3/14
USPC ..... 381/303
See application file for complete search history.

(56) References Cited

U.S. PATENT DOCUMENTS 3,920,904 A 11/1975 Blauert et al.
6,614,910 B1 9/2003 Clemow et al.
6,961,632 B2 11/2005 Hashimoto et al.
8,213,648 B2 * 7/2012 Kimijima ..... H04S 7/302 381/17
9,351,073 B1 5/2016 Alexandrov
10,009,705 B2 * 6/2018 Seldess ..... H04R 3/14
2002/0039421 A1 4/2002 Kirkeby
2005/0265558 A1 12/2005 Neoran
2007/0213990 A1 9/2007 Moon et al.
2007/0223708 A1 9/2007 Villemoes et al.

(Continued)

FOREIGN PATENT DOCUMENTS

CN 101040565 A 9/2007
CN 101346895 A 1/2009

(Continued)

OTHER PUBLICATIONS

PCT International Search Report and Written Opinion, PCT Application No. PCT/US19/23243, dated Jun. 6, 2019, 18 pages.

(Continued)

*Primary Examiner* — Ahmad F. Matar
*Assistant Examiner* — Jirapon Intavong
(74) *Attorney, Agent, or Firm* — Fenwick & West LLP

(57) ABSTRACT

An audio system processes a multi-channel surround sound input audio signal into a stereo signal for left and right speakers, while preserving the spatial sense of the sound field of the input audio signal. A subband spatial processing is performed on a left input channel, a right input channel, a left peripheral input channel, and a right peripheral input channel of the input signal to create spatially enhanced channels. Binaural filters may be applied to the peripheral input channels or the spatially enhanced channels. Crosstalk cancellation is performed on the spatially enhanced channels to create a left crosstalk cancelled channel and a right crosstalk cancelled channel.

31 Claims, 8 Drawing Sheets

(56) References Cited

U.S. PATENT DOCUMENTS

| | | | | |
|---|---|---|---|---|
| 2008/0031462 | A1 | 2/2008 | Walsh et al. | |
| 2008/0165975 | A1 | 7/2008 | Oh et al. | |
| 2008/0249769 | A1 | 10/2008 | Baumgarte | |
| 2008/0273721 | A1 | 11/2008 | Walsh | |
| 2009/0086982 | A1 | 4/2009 | Kulkarni et al. | |
| 2009/0262947 | A1 | 10/2009 | Karlsson et al. | |
| 2009/0304189 | A1 | 12/2009 | Vinton | |
| 2009/0304214 | A1 | 12/2009 | Xiang et al. | |
| 2011/0152601 | A1 | 6/2011 | Puria et al. | |
| 2011/0188660 | A1 | 8/2011 | Xu et al. | |
| 2011/0268281 | A1 | 11/2011 | Florencio et al. | |
| 2012/0099733 | A1 | 4/2012 | Wang et al. | |
| 2012/0170756 | A1 | 7/2012 | Kraemer et al. | |
| 2015/0036826 | A1 | 2/2015 | Trammell | |
| 2015/0125010 | A1* | 5/2015 | Yang | H04S 7/302 381/300 |
| 2016/0249151 | A1 | 8/2016 | Grosche et al. | |
| 2016/0286315 | A1 | 9/2016 | Zhang et al. | |
| 2017/0208411 | A1 | 7/2017 | Seldess et al. | |
| 2017/0230777 | A1 | 8/2017 | Seldess et al. | |
| 2020/0037057 | A1 | 1/2020 | Clark et al. | |
| 2020/0045493 | A1 | 2/2020 | Bharitkar | |

FOREIGN PATENT DOCUMENTS

| | | | |
|---|---|---|---|
| CN | 100481722 | C | 4/2009 |
| CN | 101406074 | A | 4/2009 |
| CN | 1941073 | B | 10/2010 |
| CN | 102007780 | A | 4/2011 |
| CN | 102737647 | A | 10/2012 |
| CN | 101884065 | B | 7/2013 |
| CN | 104519444 | A | 4/2015 |
| CN | 103765507 | B | 1/2016 |
| CN | 102893331 | B | 3/2016 |
| CN | 103928030 | B | 3/2017 |
| EP | 1 194 007 A12 | | 4/2002 |
| EP | 2 099 238 | A1 | 9/2009 |
| EP | 2 560 161 | A1 | 2/2013 |
| GB | 2419265 | A | 4/2006 |
| JP | 2000-050399 | A | 2/2000 |
| JP | 2002-159100 | A | 5/2002 |
| JP | 2007-336118 | A | 12/2007 |
| JP | 4887420 | B2 | 2/2012 |
| JP | 2013-013042 | A | 1/2013 |
| JP | 5772356 | B2 | 9/2015 |
| KR | 10-2009-0074191 | A | 7/2009 |
| KR | 10-2012-0077763 | A | 7/2012 |
| TW | I484484 | | 5/2015 |
| TW | I489447 | | 6/2015 |
| TW | 201532035 | A | 8/2015 |
| WO | WO 2004/049759 | A1 | 6/2004 |
| WO | WO 2009/022463 | A1 | 2/2009 |
| WO | WO 2009/127515 | A1 | 10/2009 |
| WO | WO 2011/151771 | A1 | 12/2011 |
| WO | WO 2012/036912 | A1 | 3/2012 |
| WO | WO 2013/181172 | A1 | 12/2013 |

OTHER PUBLICATIONS

Japan Patent Office, Official Notice of Rejection, JP Patent Application No. 2018-538234, dated Jan. 15, 2019, five pages.
New Zealand Intellectual Property Office, First Examination Report, NZ Patent Application No. 745415, dated Sep. 14, 2018, four pages.
PCT International Search Report and Written Opinion, PCT Application No. PCT/US2017/013061, dated Apr. 18, 2017, 12 pages.
PCT International Search Report and Written Opinion, PCT Application No. PCT/US2017/013249, dated Apr. 18, 2017, 20 pages.
"Bark scale," Wikipedia.org, Last Modified Jul. 14, 2016, 4 pages, [Online] [Retrieved on Apr. 20, 2017] Retrieved from the Internet<URL:https://en.wikipedia.org/wiki/Bark_scale>.
Taiwan Office Action, Taiwan Application No. 106101748, dated Aug. 15, 2017, 6 pages (with concise explanation of relevance).
Taiwan Office Action, Taiwan Application No. 106101777, dated Aug. 15, 2017, 6 pages (with concise explanation of relevance).
Korean First Office Action, Korean Application No. 2017-7031417, dated Nov. 30, 2017, 7 pages.
Korean First Office Action, Korean Application No. 2017-7031493, dated Dec. 1, 2017, 6 pages.
Taiwan Office Action, Taiwan Application No. 106138743, dated Mar. 14, 2018, 7 pages.
Korean Notice of Allowance, Korean Application No. 10-2017-7031417, dated Apr. 6, 2018, 4 pages.
Extended European Search Report, European Patent Application No. 17741783.9, dated Oct. 31, 2019, 11 pages.
Gerzon, M. "Stereo shuffling: new approach—old technique," *Studio Sound*, Jul. 1986, 28(7), 122-130.
Thomas, M.V: "Improving the stereo headphone of sound image," *Journal of the Audio Engineering Society*, Aug. 1, 1977, vol. 25, Issue 7/8, pp. 474-478.
Walsh, Michael and Jot, Jean-Marc, "Loudspeaker-Based 3-D Audio System Design Using the M-S Shuffler Matrix," Audio Engineering Society Convention 121, Convention Paper 6949, Oct. 2006, 17 pages.
European Patent Office, Extended European Search Report and Opinion, EP Patent Application No. 17741772.2, dated Jul. 17, 2019, eight pages.
China National Intellectual Property Administration, Notification of the First Office Action, CN Patent Application No. 201780018587.0, dated Feb. 26, 2020, 14 pages.
China National Intellectual Property Administration, Office Action, CN Patent Application No. 201780018313.1, dated Mar. 19, 2020, 13 pages.
United States Office Action, U.S. Appl. No. 16/599,042, dated May 12, 2020, 12 pages.

* cited by examiner

MULTI-CHANNEL SUBBAND SPATIAL PROCESSING FOR LOUDSPEAKERS

FIELD OF THE DISCLOSURE

Embodiments of the present disclosure generally relate to the field of audio signal processing and, more particularly, to spatially enhanced multi-channel audio.

BACKGROUND

Surround sound refers to sound reproduction of an audio signal including multiple channels with loudspeakers positioned around a listener. For example, 5.1 surround sound uses a six channels for a front speaker, left and right speakers, a subwoofer, and rear (or "surround") left and rear right speakers. In another example, 7.1 surround sound uses eight channels by separating the rear left and right speakers of the 5.1 surround sound configuration into four separate speakers, such as a left surround speaker, a right surround speaker, a left rear surround speaker, and a right rear surround speaker. Audio channels of the multi-channel audio signal may be associated with an angular position that corresponds with the location of the speaker to which the audio channels are output. Thus, the multi-channel audio signals allow a listener to perceive a spatial sense in the sound field when the audio signals are output to speakers at different locations. However, the spatial sense may be lost when the multi-channel audio signals for surround sound are output to stereo (e.g., left and right) loudspeakers or head-mounted speakers.

SUMMARY

Example embodiments relate to processing a (e.g., surround sound) multi-channel input audio signal into a stereo output signal for left and right speakers, while preserving or enhancing the spatial sense of the sound field of the multi-channel input audio signal. Among other things, the processing results in a listening experience whereby each channel of audio signal is perceived as originating from the same or similar direction as would occur if the audio signal were rendered on a surround sound system (e.g., 5.1, 7.1, etc.).

In some example embodiments, a multi-channel input audio signal including a left input channel, a right input channel, a left peripheral input channel, and a right peripheral input channel is received. A subband spatial processing is performed on the left input channel, the right input channel, the left peripheral input channel, and the right peripheral input channel to create spatially enhanced channels. The subband spatial processing may include gain adjusting mid and side subband components of the left input channel, the right input channel, the left peripheral input channel, and the right peripheral input channel. Crosstalk cancellation is performed on the spatially enhanced channels to create a crosstalk cancelled left channel and a right crosstalk cancelled channel. A left outpout channel is generated from the left crosstalk cancelled channel and a right output channel is generated from the right crosstalk cancelled channel.

The left and right peripheral channels may include a left surround input channel and a right surround input channel, and/or a left surround rear input channel and a right surround rear input channel. The multi-channel input audio signal may further include a center channel and a low frequency channel that may be combined with the output of the crosstalk cancellation.

In some embodiments, the subband spatial processing is performed on each of the corresponding pairs of left right channels. For example, subband spatial processing may be performed by gain adjusting the mid subband components and the side subband components of the left input channel and the right input channel, gain adjusting the mid subband components and the side subband components of the left peripheral input channel and the right peripheral input channel, and combining the gain adjusted mid subband components and the gain adjusted side subband components of the left input channel, the right input channel, the left peripheral input channel, and the right peripheral input channel into a left combined channel and a right combined channel. The crosstalk cancellation is performed on the left and right combined channels to generate the output channels.

In some embodiments, the subband spatial processing is performed on combined left and right channels. For example, the subband spatial processing may include combining the left input channel and the left peripheral input channel into a left combined channel, combining the right input channel and the right peripheral input channel into a right combined channel, and gain adjusting mid subband components and the side subband components of the left combined channel and the right combined channel to create a left spatially enhanced channel and a right spatially enhanced channel. The crosstalk cancellation is performed on the left and right spatially enhanced channels to generate the output channels.

In some embodiments, a binaural filter is applied to at least a portion of the input channels. For example, a binaural filter is applied to the peripheral input channels to adjust for angular positions associated with the peripheral input channels. In some embodiments, a binaural filter is applied to any input channel as suitable to adjust for the angular positions associated with the input channel, including the left or right input channels.

Some embodiments may include a system for processing a multi-channel input audio signal. The system includes circuitry configured to: receive the multi-channel input audio signal including a left input channel, a right input channel, a left peripheral input channel, and a right peripheral input channel; perform subband spatial processing on the left input channel, the right input channel, the left peripheral input channel, and the right peripheral input channel to create spatially enhanced channels, the subband spatial processing including gain adjusting mid and side subband components of the left input channel, the right input channel, the left peripheral input channel, and the right peripheral input channel; perform crosstalk cancellation on the spatially enhanced channels to create a left crosstalk cancelled channel and a right crosstalk cancelled channel; and generate a left output channel from the left crosstalk cancelled channel and a right output channel from the right crosstalk cancelled channel.

Some embodiments may include a non-transitory computer readable medium storing program code. The program code may be software comprised of executable instructions. The program code may be executed by one or more processors. The program code, when executed by a processor, causes the processor to receive a multi-channel input audio signal including a left input channel, a right input channel, a left peripheral input channel, and a right peripheral input channel. When executed, the program code when executed by the processor may cause the processor to perform subband spatial processing on the left input channel, the right input channel, the left peripheral input channel, and the right peripheral input channel to create spatially enhanced channels. The subband spatial processing may include gain adjusting mid and side subband components of the left input channel, the right input channel, the left peripheral input channel, and the right peripheral input channel. The program code when executed by the processor may cause the processor to perform crosstalk cancellation on the spatially enhanced channels to create a left crosstalk cancelled channel and a right crosstalk cancelled channel. The program code when executed by the processor also may cause the processor to generate a left output channel from the left crosstalk cancelled channel and a right output channel from the right crosstalk cancelled channel.

DETAILED DESCRIPTION

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

The Figures (FIG.) and the following description relate to the preferred embodiments by way of illustration only. It should be noted that from the following discussion, alternative embodiments of the structures and methods disclosed herein will be readily recognized as viable alternatives that may be employed without departing from the principles of the present invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments for purposes of illustration only. One skilled in the art will readily recognize from the following description that alternative embodiments of the structures and methods illustrated herein may be employed without departing from the principles described herein.

Example Surround Sound Stereo and Example Audio System

The audio systems discussed herein provide crosstalk processing and spatial enhancement for multi-channel surround sound audio signal for output to stereo (e.g., left and right) speakers. The signal processing results in the preserving or enhancing of the spatial sense of the sound field encoded in the multi-channel surround sound audio signal. Among other things, the spatial sense achieved using multi-speaker surround sound systems is achieved using stereo loudspeakers.

Figure 1:
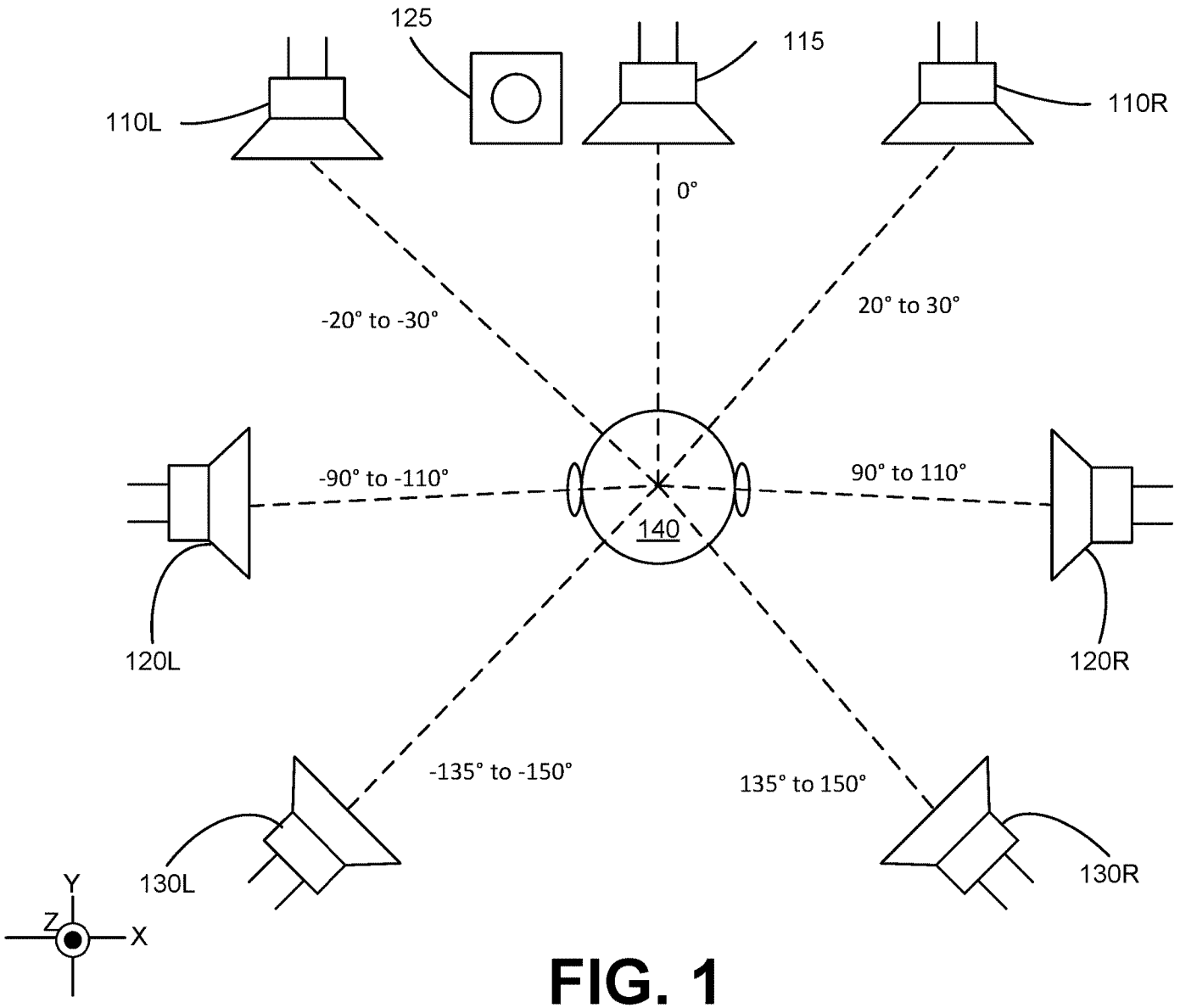
FIG. 1 illustrates an example of a surround sound stereo audio reproduction system, according to one embodiment.

FIG. 1 illustrates an example of a surround sound stereo audio reproduction system 100, according to one embodiment. The system 100 is an example of a 7.1 surround sound system that provides audio signal reproduction to a listener 140. The system 100 includes a left speaker 110L, a right speaker 110R, a center speaker 115, a subwoofer 125, a left surround speaker 120L, a right surround speaker 120R, a left surround rear speaker 130L, and a right surround speaker 130R. The center speaker 115 and subwoofer 125 may be positioned in front of the listener 140, which defines a forward axis at 0°. The left speaker 110L may be positioned at an angle between −20° to −30° relative to the forward axis, and the right speaker 110R may be positioned at an angle between 20° to 30° relative to the forward axis. The left surround speaker 120L may be positioned at an angle between −90° to −110° relative to the forward axis, and the right surround speaker 120R may be positioned at an angle between 90° to 110° relative to the forward axis. The left surround rear speaker 130L may be positioned at an angle between −135° to −150° relative to the forward axis, and the right surround speaker 130R may be positioned at an angle between 135° to 150° relative to the forward axis. The system 100 may be configured to receive an audio signal including channels for each of the speakers 110, 115, 120, and 130 and the subwoofer 125. The multiple speakers and their positional arrangement provides for a spatial sense in the sound field that can be perceived by the listener 140. As discussed in greater detail below, the audio system may be configured to process a multi-channel input audio signal for the surround sound system 100 into an enhanced stereo signal for left and right speakers (e.g., speakers 110L and 110R) that reproduces or simulates the spatial sense in the sound field generated by the surround sound system 100 using the multi-channel audio signal.

Figure 2:
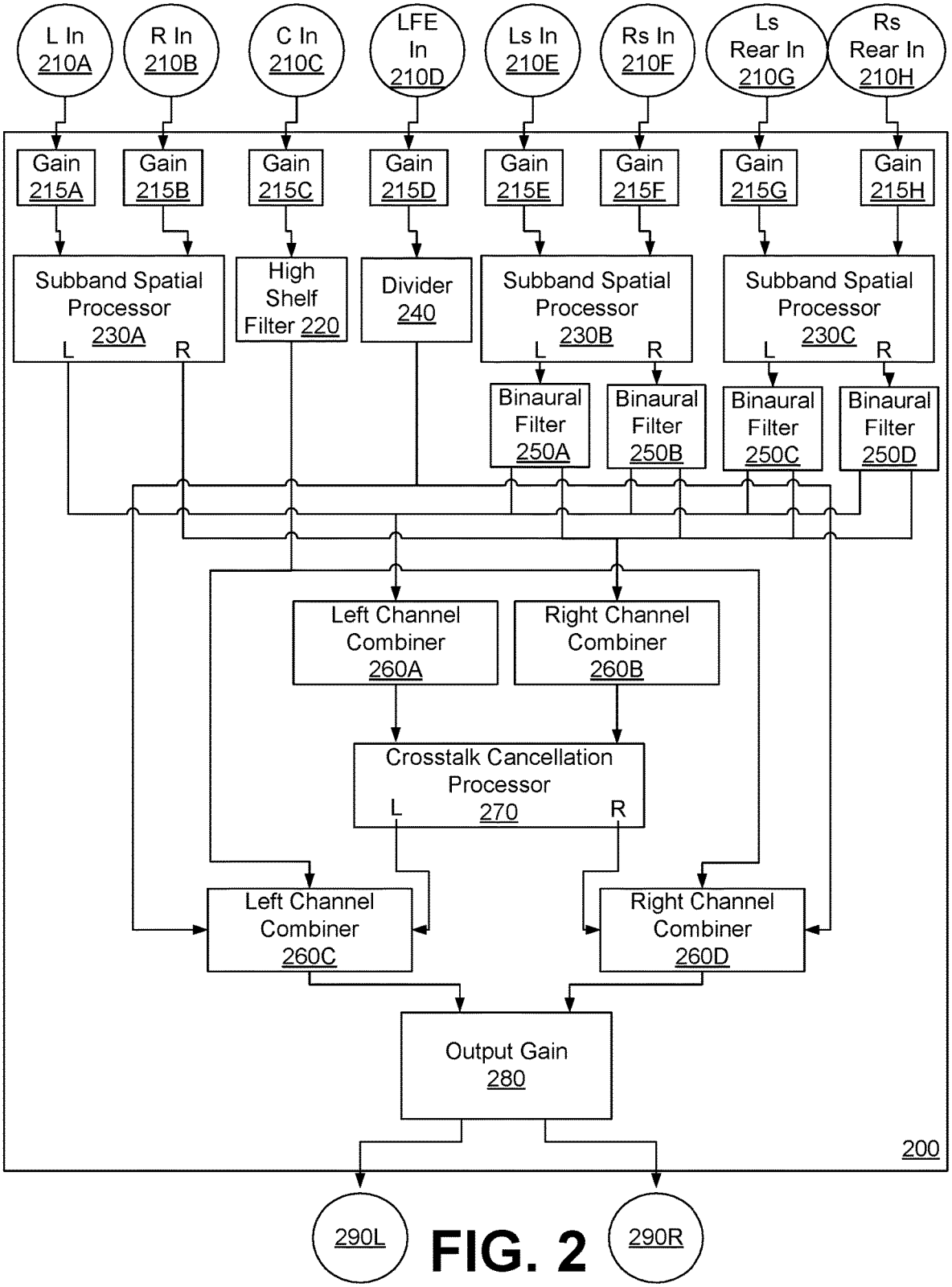
FIG. 2 illustrates an example of an audio system, according to one embodiment.

FIG. 2 illustrates an example of an audio system 200, according to one embodiment. The audio system 200 receives an input audio signal including a left input channel 201A, a right input channel 210B, a center input channel 210C, a low frequency input channel 210D, a left surround input channel 210E, a right surround input channel 210F, a left surround rear input channel 210G, and a right surround rear input channel 210H.

The channels 210E, 210F, 210G, and 210H are examples of peripheral channels for surround speakers. Peripheral channels may include channels other than the left and right input channels. Peripheral channels may include channel pairs, such as left-right pairs, or front-back pairs, or other pair arrangements. For example, when the input audio signal is output by the surround sound stereo audio reproduction system 100, the left surround speaker 120L receives the left surround input channel 210E, the right surround speaker 120R receives the right surround input channel 210F, the left surround rear speaker 130L receives the left surround rear input channel 210G, and the right surround rear speaker 130R receives the right surround rear input channel 210H. In some embodiments, the input audio signal has fewer or more peripheral channels. For example, an audio input signal for a 5.1 surround sound system may include only two peripheral channels, such as left and right surround input channels that may be output to left and right surround speakers. Similarly, the left speaker 110L may receive the left input channel 210A, the right speaker 110R may receive the right input channel 210B, the center speaker 115 may receive the center input channel 210C, and the subwoofer 125 may receive the low frequency input channel 210D. The input audio signal provides a spatial sense of the sound field when output by the surround sound stereo audio reproduction system 100.

The audio system 200 receives the input audio signal and generates an output signal including a left output channel 290L and a right output channel 290R. The audio system 200 may combine the input channels of the input audio signal, and may further provide enhancements such as subband spatial processing and crosstalk cancellation, to generate the output audio signal. The left output channel 290L may be provided to a left speaker and the right output channel 290R may be output to a right speaker. The output audio signal provides a spatial sense of the sound field using the left and right speakers (e.g., left speaker 110L and right speaker 110R) that is typically achieved by outputting the input audio signal using a surround sound system including multiple (e.g., peripheral) speakers.

The audio system 200 includes gains 215A, 215B, 215C, 215D, 215E, 215F, 215G, and 215H, sub-band spatial processors 230A, 230B, and 230C, a high shelf filter 220, a divider 240, binaural filters 250A, 250B, 250C, and 250D, a left channel combiner 260A, a right channel combiner 260B, a crosstalk cancellation processor 270, a left channel combiner 260C, a right channel combiner 260D, and an output gain 280.

Each of the gains 215A through 215H may receive a respective input channel 210A through 210H, and may apply a gain to an input channel 210A through 210H. The gains 215A through 215H may be different to adjust gains of the input channels with respect to each other, or may be the same. In some embodiments, positive gains are applied to the left and right peripheral input channels 210E, 210F, 210G, and 210H, and a negative gain is applied to the center channel 210C. For example, the gain 215A may apply a 0 db gain, the gain 215B may apply a 0 dB gain, the gain 215C may apply a −3 dB gain, the gain 215D may apply a 0 db gain, the gain 215E may apply a 3 dB gain, the gain 215F may apply a 3 dB gain, the gain 215G may apply a 3 dB gain, and the gain 215H may apply a 3 dB gain.

The gain 215A and gain 215B are coupled to the subband spatial processor 230. Similarly, the gains 215E and 215F are coupled to the subband spatial proricessor 230B, and the gains 215G and 215H are coupled to the subband spatial processor 230C. The subband spatial processors 230A, 230B, and 230C each apply subband spatial processing to corresponding left and right channel pairs.

Each subband spatial processor 230 performs subband spatial processing on a left and right input channel by gain adjusting mid and side subband components of the left and right input channels to generate left and right spatially enhanced channels. The subband spatial processor 230A performs the subband spatial processing on the left and right input channels, while other subband spatial processors 230B and 230C each perform the subband spatial processing to corresponding left and right peripheral channels. Depending on the number of peripheral channels in the input audio signal, the audio system 200 may include more or less subband spatial processors. In some embodiments, channels without left/right counterparts (such as the center input channel 210C, the low frequency input channel 210D, or other types of channels such as rear-center, overhead-center, etc.) can bypass SBS processing.

Figure 3:
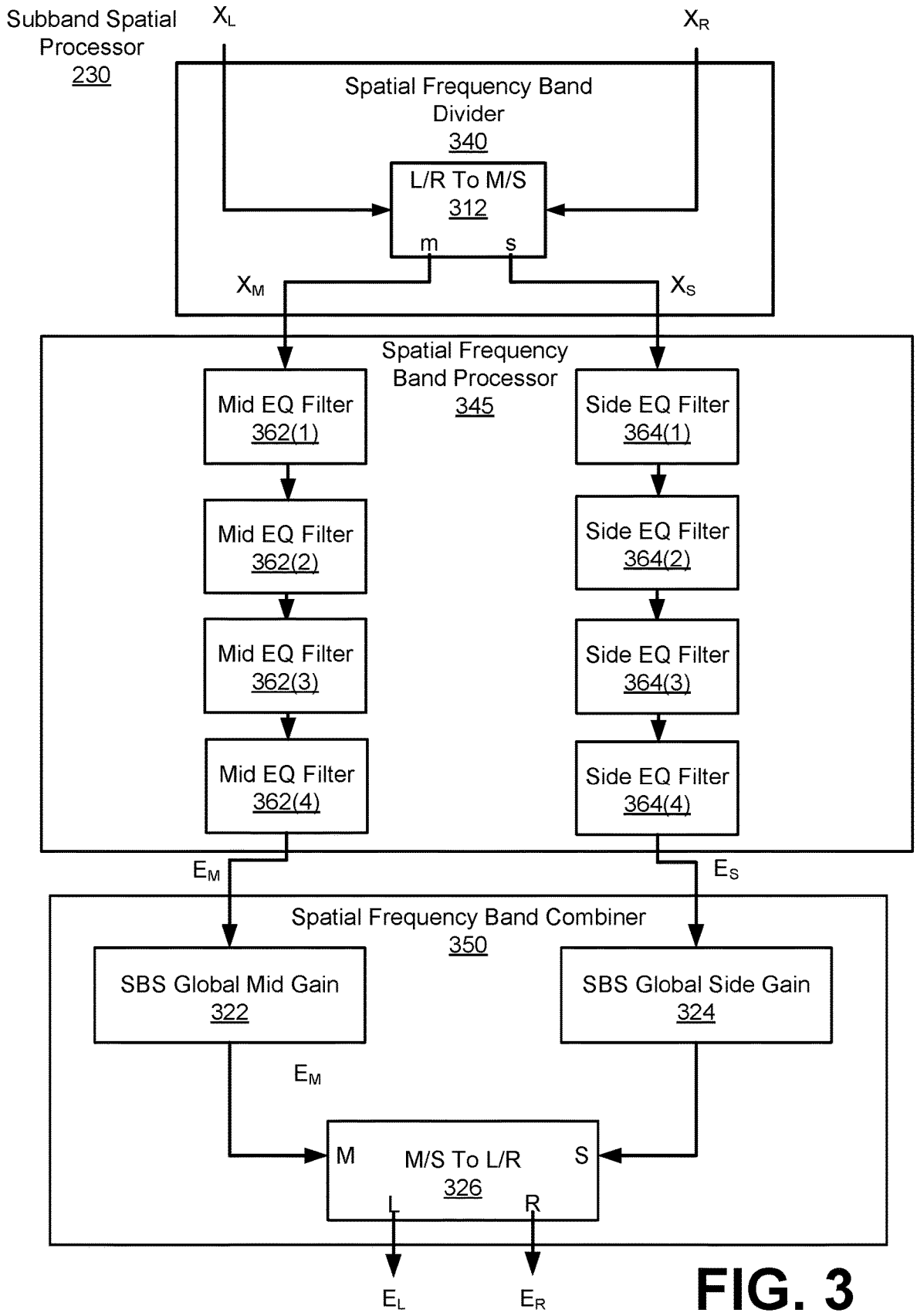
FIG. 3 illustrates an example of a subband spatial processor, according to one embodiment.

The subband spatial processor 230B is coupled to the binaural filters 250A and 250B. The subband spatial processor 230B provides a left spatially enhanced channel to the binaural filter 250A, and provides a right spatially enhanced channel to the binaural filter 250B. Similarly, the subband spatial processor 230C is coupled to the binaural filters 250C and 250D. The subband spatial processor 230C provides a left spatially enhanced channel to the binaural filter 250C, and provides a right spatially enhanced channel to the binaural filter 250D. Additional details regarding a subband spatial processor 230 are shown in FIG. 3 and discussed below.

Each of the binuaral filters 250A, 250B, 250C, and 250D apply a head-related transfer function (HRTF) that describes the target source location from which the listener should perceive the sound of the input channel. Each binaural filter receives an input channel and generates a left and right output channel by applying a HRTF that adjusts for an angular position associated with the input channel. The angular position may include an angle defined in an X-Y "azimuthal" plane relative to listener 140 the as shown in FIG. 1, and may further include an angle defined in the Z axis, such as for an ambisonics signal or a channel-based format containing signals intended to be rendered above or below the X-Y plane relative to the listener 140. For example, the binaural filter 250A may be configured to apply a filter based on the left surround input channel 210E being associated with the angle (defined in the X-Y plane) between −90° to −110° relative to the forward axis of the left surround speaker 120L. The binaural filter 250B may be configured to apply a filter based on the right surround input channel 210F being associated the angle between 90° to 110° relative to the forward axis of the right surround speaker 120L. The binaural filter 250C may be configured to apply a filter based on the left surround rear input channel 210G being associated with the angle between −135° to −150° relative to the forward axis of the left surround rear speaker 130L. The binaural filter 250D may be configured to apply a filter based on the right surround rear input channel 210H being associated with the angle between 135° to 150° relative to the forward axis of the rear speaker 130R. In some embodiments, the binaural processing may be bypassed entirely in order to preserve inter-channel spectral uniformity. One or more of the binuaral filters 250A, 250B, 250C, and 250D may be omitted from the audio system 200. However, the binuaral filters 250A, 250B, 250C, and 250D may be used to enhance spatial imaging. In some embodiments, binaural filtering may be applied to channels other than peripheral input channels. For example, a binaural filter may be applied to each of the left and right spatially enhanced channels that are output from the subband spatial processor 230A to adjust for different left and right output speaker location. In another example, if the input audio signal includes channels associated with other speaker locations (i.e. Overhead, Rear-Center, etc.), then binaural processing may be applied to the other input channels. In that sense, binaural processing may be applied to one or more of the left input channel 210A, the right input channel 210B, the center input channel 210C, or the low frequency input channel 210D. In some embodiments, HRTFs are not applied, and one or more of the binuaral filters 250A, 250B, 250C, and 250D may be bypassed or omitted from the system 200.

An example binaural filter may be defined by Equation 1:

$$S_o(z)=H(\theta,z)S_i(z) \quad \text{Eq. (1)}$$

where $S_o$ and $S_i$ are the output and input signals, respectively. The argument θ encodes the angle of each channel in $S_i$ and $S_o$. The value z is an arbitrary complex number, of which our solution is a function, encoding frequency. H(θ,z) is therefore a function of both angle θ and z, returning a transfer function, itself a function of z, which may be selected or interpolated among a collection of transfer functions, perhaps derived from an anthropometric database. In this notation, the angle θ, as well as S and H(θ) as functions of z may evaluate to vectors if multichannel processing is desired. In this case, each coefficient in S(z), and H(θ,z) corresponds to a different channel, while each coefficient in θ associates an angle to each channel.

In some embodiments, the input audio signal is an ambisonics audio signal defining a speaker-independent representation of a sound field. The ambisonics audio signal may be decoded into a multi-channel audio signal for a surround sound system. The channels may be associated with speaker locations at various locations, including locations that are above or below the listener. A binaural filter may be applied to each decoded input channel of the ambisonics audio signal to adjust for the associated position of the decoded input audio channel.

In some embodiments, the binaural filtering is performed prior to subband spatial processing. For example, a binaural filter may be applied to one or more of the input channels as suitable to adjust for angular positions associated with the channels. For each left-right input channel pair, the left output channels of the binaural filters may be combined, and right output channels of the binaural filters may be combined, and the subband spatial processing may be applied to the combined left and right channels. In some embodiments, binaural filters are applied to the center input channel 210C or the low frequency input channel 210D. In some embodiments, binaural filters are applied to each input channel except the low frequency input channel 210D.

The left channel combiner 260A is coupled to the subband spatial processor 230A, and the binaural filters 250A, 250B, 250C, and 250D. The left channel combiner 260A receives the left output channels of the subband subband spatial processor 230A, and the binaural filters 250A, 250B, 250C, and 250D, and combines these channels into a left combined channel. The right channel combiner 260B is also coupled to the subband spatial processor 230A, and the binaural filters 250A, 250B, 250C, and 250D. The right channel combiner 260B receives the right output channels of the subband subband spatial processor 230A, and the binaural filters 250A, 250B, 250C, and 250D, and combines these channels into a right combined channel.

Figure 4:
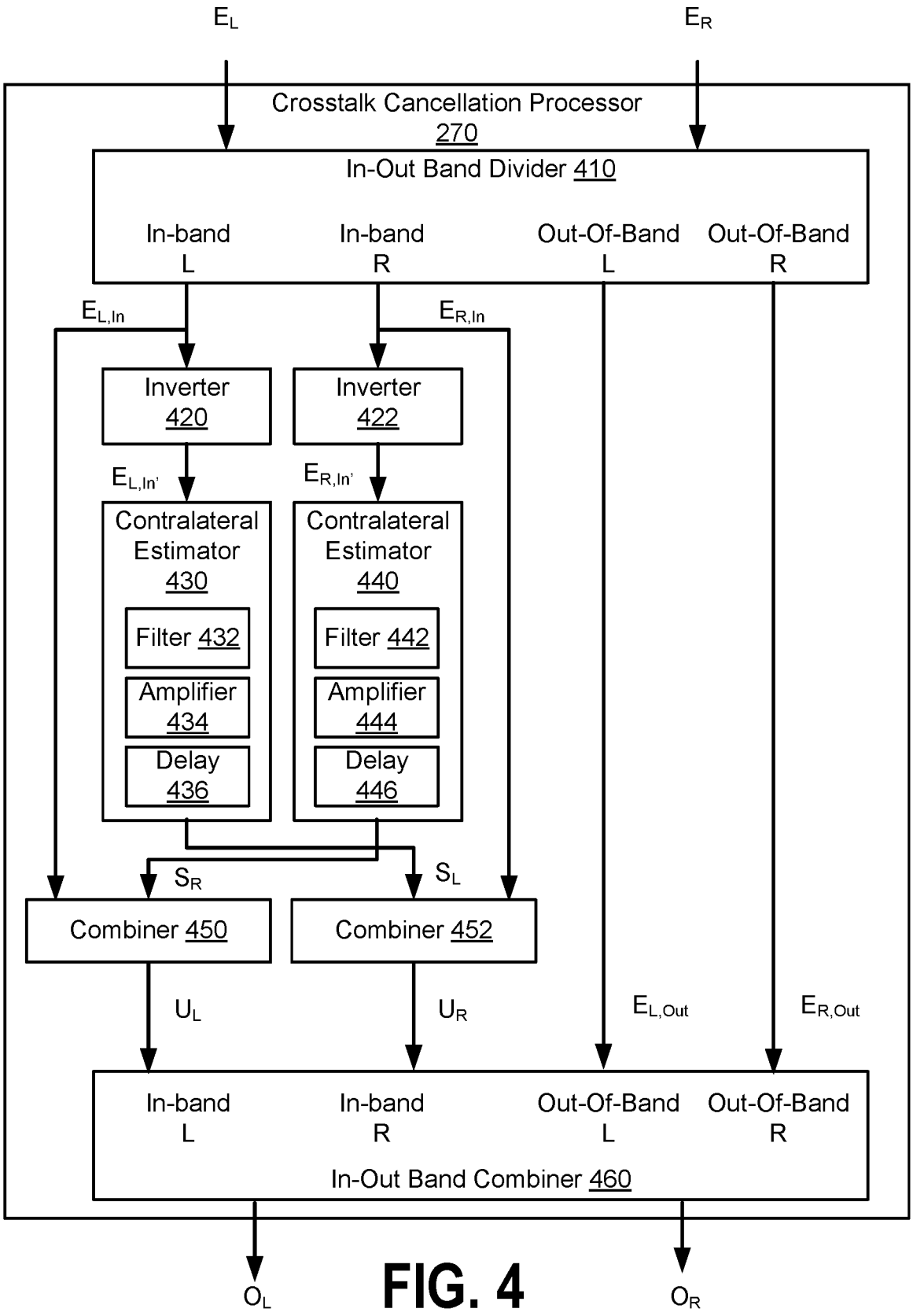
FIG. 4 illustrates an example of a crosstalk cancellation processor, according to one embodiment.

The crosstalk cancellation processor 270 receives left and right input channels and performs a crosstalk cancellation to generate left and right crosstalk cancelled channels. The crosstalk cancellation processor is coupled to the left channel combiner 260A to receive a left combined channel, and the right channel combiner 260B to receive a right combined channel. Here, the left and right combined channels processed by the crosstalk cancellation processor 270 represent mixed down left and right counterpart input channels. Additional details regarding the crosstalk cancellation processor 270 are shown in FIG. 4 and discussed below.

The high shelf filter 220 receives the center input channel 210C and applies a high frequency shelving or peaking filter. The high shelf filter 220 provides a "voice-lift" on the center input channel 210C. In some embodiments, the high shelf filter 220 is bypassed, or omitted from the audio system 200. The high shelf filter 220 may attenuate or amplify frequencies above a corner frequency. The high shelf filter 220 is coupled to the left channel combiner 260C and the right channel combiner 260D. In some embodiments, the high shelf filter 220 is defined by a 750 Hz corner frequency, a +3 dB gain, and 0.8 Q factor. The high shelf filter 220 generates a left center channel and a right center channel as output, such as by separating the center input channel into two separate left and right center channels.

The divider 240 receives the low frequency input channel 210D, and separates the low frequency input channel 210D into left and right low frequency channels. The divider 240 is coupled to the left channel combiner 260C and the right channel combiner 260D, and provides the left low frequency channel to the left channel combiner 260C and the right low frequency channel to the right channel combiner 260D.

The left channel combiner 260C is coupled to the crosstalk cancellation processor 270, the high shelf filter 220, and the divider 240. The left channel combiner 260C receives the left crosstalk channel from the crosstalk cancellation processor 270, the left center channel from the high shelf filter 220, and the left low frequency channel from the divider 240, and combines these channels into a left output channel.

Right channel combiner 260D is coupled to the crosstalk cancellation processor 270, the high shelf filter 220, and the divider 240. The right channel combiner 260D receives the right crosstalk channel from the crosstalk cancellation processor 270, the right output channel from the high shelf filter 220, and the right low frequency channel from the divider 240, and combines these channels into a right output channel.

In some embodiments, the left center channel from the high shelf filter 220 and the left low frequency channel from the divider 240 are combined by the left channel combiner 260A with the left spatially enhanced channel from the subband spatial processor 230A and the left output channels of the binaural filters 250A, 250B, 250C, and 250D to generate the left combined channel. Similarly, the right output channel from the high shelf filter 220 and the right low frequency channel from the divider 240 are combined by the right channel combiner 260 with the right spatially enhanced channel from the subband subband spatial processor 230A and the right output channels of the binaural filters 250A, 250B, 250C, and 250D to generate the right combined channel. The left and right combined channels are input into the crosstalk cancellation processor 270. Here, the center and low frequency channels receive the crosstalk cancellation operation. The left channel combiner 260C and right channel combiner 260D may be omitted. In some embodiments, one of the center or low frequency channels receives the crosstalk cancellation operation.

The output gain 280 is coupled to left channel combiner 260C and the right channel combiner 260D. The output gain 280 applies a gain to the left output channel from the left channel combiner 260C, and applies a gain to the right output channel from the right channel combiner 260D. The output gain 280 may apply the same gain to the left and right output channels, or may apply different gains. The output gain 280 outputs the left output channel 290L and the right output channel 290R which represent the channels of the output signal of the audio system 200.

Example Subband Spacial Processor

FIG. 3 illustrates an example of a subband spatial processor 230, according to one embodiment. The subband spatial processor 230 is an example of the subband spatial processors 230A, 230B, or 230C of the audio system 200. The subband spatial processor 230 includes a spatial frequency band divider 340, a spatial frequency band processor 345, and a spatial frequency band combiner 350. The spatial frequency band divider 340 is coupled to the spatial frequency band processor 345, and the spatial frequency band processor 345 is coupled to the spatial frequency band cominber 350.

The spatial frequency band divider 340 includes an L/R to M/S converter 312 that receives a left input channel $X_L$ and a right input channel $X_R$, and converts these inputs into a spatial component $X_m$ and the nonspatial component $X_s$. The spatial component $X_s$ may be generated by subtracting the left input channel $X_L$ and right input channel $X_R$. The nonspatial component $X_m$ may be generated by adding the left input channel $X_L$ and the right input channel $X_R$.

The spatial frequency band processor 345 receives the nonspatial component $X_m$ and applies a set of subband filters to generate the enhanced nonspatial subband component $E_m$. The spatial frequency band processor 345 also receives the spatial subband component $X_s$ and applies a set of subband filters to generate the enhanced nonspatial subband component $E_m$. The subband filters can include various combinations of peak filters, notch filters, low pass filters, high pass filters, low shelf filters, high shelf filters, bandpass filters, bandstop filters, and/or all pass filters.

In some embodiments, the spatial frequency band processor 345 includes a subband filter for each of n frequency subbands of the nonspatial component $X_m$ and a subband filter for each of the n frequency subbands of the spatial component $X_s$. For n=4 subbands, for example, the spatial frequency band processor 345 includes a series of subband filters for the nonspatial component $X_m$ including a mid equalization (EQ) filter 362(1) for the subband (1), a mid EQ filter 362(2) for the subband (2), a mid EQ filter 362(3) for the subband (3), and a mid EQ filter 362(4) for the subband (4). Each mid EQ filter 362 applies a filter to a frequency subband portion of the nonspatial component $X_m$ to generate the enhanced nonspatial component $E_m$.

The spatial frequency band processor 345 further includes a series of subband filters for the frequency subbands of the spatial component $X_s$, including a side equalization (EQ) filter 364(1) for the subband (1), a side EQ filter 364(2) for the subband (2), a side EQ filter 364(3) for the subband (3), and a side EQ filter 364(4) for the subband (4). Each side EQ filter 364 applies a filter to a frequency subband portion of the spatial component $X_s$ to generate the enhanced spatial component $E_s$.

Each of the n frequency subbands of the nonspatial component $X_m$ and the spatial component $X_s$ may correspond with a range of frequencies. For example, the frequency subband (1) may corresponding to 0 to 300 Hz, the frequency subband (2) may correspond to 300 to 510 Hz, the frequency subband (3) may correspond to 510 to 2700 Hz, and the frequency subband (4) may correspond to 2700 Hz to Nyquist frequency. In some embodiments, the n frequency subbands are a consolidated set of critical bands. The critical bands may be determined using a corpus of audio samples from a wide variety of musical genres. A long term average energy ratio of mid to side components over the 24 Bark scale critical bands is determined from the samples. Contiguous frequency bands with similar long term average ratios are then grouped together to form the set of critical bands. The range of the frequency subbands, as well as the number of frequency subbands, may be adjustable.

In some embodiments, the mid EQ filters 362 or side EQ filters 364 may include a biquad filter, having a transfer function defined by Equation 2:

$$H(z) = \frac{b_0 + b_1 z^{-1} + b_2 z^{-2}}{a_0 + a_1 z^{-1} + a_2 z^{-2}} \quad \text{Eq. (2)}$$

where z is a complex variable. The filter may be implemented using a direct form I topology as defined by Equation 3:

$$Y[n] = \frac{b_0}{a_0} X[n-1] + \frac{b_1}{a_0} X[n-1] + \frac{b_2}{a_0} X[n-2] - \frac{a_1}{a_0} Y[n-1] - \frac{a_2}{a_0} Y[n-2] \quad \text{Eq. (3)}$$

where X is the input vector, and Y is the output. Other topologies might have benefits for certain processors, depending on their maximum word-length and saturation behaviors.

The biquad can then be used to implement any second-order filter with real-valued inputs and outputs. To design a discrete-time filter, a continuous-time filter is designed and transformed it into discrete time via a bilinear transform. Furthermore, compensation for any resulting shifts in center frequency and bandwidth may be achieved using frequency warping.

For example, a peaking filter may include an S-plane transfer function defined by Equation 4:

$$H(s) = \frac{s^2 + s\left(\frac{A}{Q}\right) + 1}{s^2 + s\left(\frac{A}{Q}\right) + 1} \quad \text{Eq. (4)}$$

where s is a complex variable, A is the amplitude of the peak, and Q is the filter "quality" (canonically derived as:

$$Q = \frac{f_c}{\Delta f}).$$

The digital filters coefficients are:

$$b_0 = 1 + \alpha A$$

$$b_1 = -2 * \cos(\omega_0)$$

$$b_2 = 1 - \alpha A$$

$$a_0 = 1 + \frac{\alpha}{A}$$

$$a_1 = -2\cos(\omega_0)$$

$$a_2 = 1 + \frac{\alpha}{A}$$

where $\omega_0$ is the center frequency of the filter in radians and $$\alpha = \frac{\sin(\omega_0)}{2Q}.$$

The spatial frequency band combiner 350 receives mid and side components, applies gains to each of the components, and converts the mid and side components into left and right channels. For example, the spatial frequency band combiner 350 receives the enhanced nonspatial component $E_m$ and the enhanced spatial component $E_s$, and performs global mid and side gains before converting the enhanced nonspatial component $E_m$ and the enhanced spatial component $E_s$ into the left spatially enhanced channel $E_L$ and the right spatially enhanced channel $E_R$.

More specifically, the spatial frequency band combiner 350 includes a global mid gain 322, a global side gain 324, and an M/S to L/R converter 326 coupled to the global mid gain 322 and the global side gain 324. The global mid gain 322 receives the enhanced nonspatial component $E_m$ and applies a gain, and the global side gain 324 receives the enhanced spatial component $E_s$ and applies a gain. The M/S to L/R converter 326 receives the enhanced nonspatial component $E_m$ from the global mid gain 322 and the enhanced spatial component $E_s$ from the global side gain 324, and converts these inputs into the left spatially enhanced channel $E_L$ and the right spatially enhanced channel $E_R$.

Example Crosstalk Cancellation Processor

FIG. 4 illustrates a crosstalk cancellation processor 270, according to one example embodiment. The crosstalk cancellation processor 270 receives the left spatially enhanced channel $E_L$ as input from the left channel combiner 260A and the right spatially enhanced channel $E_R$ as input from the right channel combiner 260B, and performs crosstalk cancellation on the channels $E_L$, $E_R$ to generate the left output channel $O_L$, and the right output channel $O_R$.

The crosstalk cancellation processor 270 includes an in-out band divider 410, inverters 420 and 422, contralateral estimators 430 and 440, combiners 450 and 452, and an in-out band combiner 460. These components operate together to divide the input channels $T_L$, $T_R$ into in-band components and out-of-band components, and perform a crosstalk cancellation on the in-band components to generate the output channels $O_L$, $O_R$.

By dividing the input audio signal E into different frequency band components and by performing crosstalk cancellation on selective components (e.g., in-band components), crosstalk cancellation can be performed for a particular frequency band while obviating degradations in other frequency bands. If crosstalk cancellation is performed without dividing the input audio signal E into different frequency bands, the audio signal after such crosstalk cancellation may exhibit significant attenuation or amplification in the nonspatial and spatial components in low frequency (e.g., below 350 Hz), higher frequency (e.g., above 12000 Hz), or both. By selectively performing crosstalk cancellation for the in-band (e.g., between 250 Hz and 14000 Hz), where the vast majority of impactful spatial cues reside, a balanced overall energy, particularly in the nonspatial component, across the spectrum in the mix can be retained.

The in-out band divider 410 separates the input channels $E_L$, $E_R$ into in-band channels $E_{L,In}$, $E_{R,In}$ and out of band channels $E_{L,Out}$, $E_{R,Out}$, respectively. Particularly, the in-out band divider 410 divides the left enhanced compensation channel $E_L$ into a left in-band channel $E_{L,In}$ and a left out-of-band channel $E_{L,Out}$. Similarly, the in-out band divider 410 separates the right enhanced compensation channel $E_R$ into a right in-band channel $E_{R,In}$ and a right out-of-band channel $E_{R,Out}$. Each in-band channel may encompass a portion of a respective input channel corresponding to a frequency range including, for example, 250 Hz to 14 kHz. The range of frequency bands may be adjustable, for example according to speaker parameters.

The inverter 420 and the contralateral estimator 430 operate together to generate a left contralateral cancellation component $S_L$ to compensate for a contralateral sound component due to the left in-band channel $E_{L,In}$. Similarly, the inverter 422 and the contralateral estimator 440 operate together to generate a right contralateral cancellation component $S_R$ to compensate for a contralateral sound component due to the right in-band channel $E_{R,In}$.

In one approach, the inverter 420 receives the in-band channel $E_{L,In}$ and inverts a polarity of the received in-band channel $E_{L,In}$ to generate an inverted in-band channel $E_{L,In}'$. The contralateral estimator 430 receives the inverted in-band channel $E_{L,In}'$, and extracts a portion of the inverted in-band channel $E_{L,In}'$ corresponding to a contralateral sound component through filtering. Because the filtering is performed on the inverted in-band channel $E_{L,In}'$, the portion extracted by the contralateral estimator 430 becomes an inverse of a portion of the in-band channel $E_{L,In}$ attributing to the contralateral sound component. Hence, the portion extracted by the contralateral estimator 430 becomes a left contralateral cancellation component $S_L$, which can be added to a counterpart in-band channel $E_{R,In}$ to reduce the contralateral sound component due to the in-band channel $E_{L,In}$. In some embodiments, the inverter 420 and the contralateral estimator 430 are implemented in a different sequence.

The inverter 422 and the contralateral estimator 440 perform similar operations with respect to the in-band channel $E_{R,In}$ to generate the right contralateral cancellation component $S_R$. Therefore, detailed description thereof is omitted herein for the sake of brevity.

In one example implementation, the contralateral estimator 430 includes a filter 432, an amplifier 434, and a delay unit 436. The filter 432 receives the inverted input channel $E_{L,In}'$ and extracts a portion of the inverted in-band channel $E_{L,In}'$ corresponding to a contralateral sound component through a filtering function. An example filter implementation is a Notch or Highshelf filter with a center frequency selected between 5000 and 10000 Hz, and Q selected between 0.5 and 1.0. Gain in decibels ($G_{dB}$) may be derived from Equation 5:

$$G_{dB}=-3.0-\log_{1.333}(D) \quad \text{Eq. (5)}$$

where D is a delay amount by delay unit 1556A/B in samples, for example, at a sampling rate of 48 KHz. An alternate implementation is a Lowpass filter with a corner frequency selected between 5000 and 10000 Hz, and Q selected between 0.5 and 1.0. Moreover, the amplifier 434 amplifies the extracted portion by a corresponding gain coefficient $G_{L,In}$, and the delay unit 436 delays the amplified output from the amplifier 434 according to a delay function D to generate the left contralateral cancellation component $S_L$. The contralateral estimator 440 includes a filter 442, an amplifier 444, and a delay unit 446 that performs similar operations on the inverted in-band channel $E_{R,In}'$ to generate the right contralateral cancellation component $S_R$. In one example, the contralateral estimators 430, 440 generate the left contralateral cancellation components $S_L$, $S_R$, according to equations below:

$$S_L=D[G_{L,In}*F[E_{L,In}']] \quad \text{Eq. (6)}$$

$$S_R=D[G_{R,In}*F[E_{R,In}']] \quad \text{Eq. (7)}$$

where F[ ] is a filter function, and D[ ] is the delay function.

The configurations of the crosstalk cancellation can be determined by the speaker parameters. In one example, filter center frequency, delay amount, amplifier gain, and filter gain can be determined, according to an angle formed between two outputs speakers of the output signal with respect to a listener, or other features of the speaker such as relative position, power, etc. In some embodiments, values between the speaker angles are used to interpolate other values.

The combiner 450 combines the right contralateral cancellation component $S_R$ to the left in-band channel $E_{L,In}$ to generate a left in-band compensation channel $U_L$, and the combiner 452 combines the left contralateral cancellation component $S_L$ to the right in-band channel $E_{R,In}$ to generate a right in-band compensation channel $U_R$. The in-out band combiner 460 combines the left in-band compensation channel $U_L$ with the out-of-band channel $E_{L,out}$ to generate the left output channel $O_L$, and combines the right in-band compensation channel $U_R$ with the out-of-band channel $E_{R,Out}$ to generate the right output channel $O_R$.

Accordingly, the left output channel $O_L$ includes the right contralateral cancellation component $S_R$ corresponding to an inverse of a portion of the in-band channel $T_{R,In}$ attributing to the contralateral sound, and the right output channel $O_R$ includes the left contralateral cancellation component $S_L$ corresponding to an inverse of a portion of the in-band channel $T_{L,In}$ attributing to the contralateral sound. In this configuration, a wavefront of an ipsilateral sound component output by a right speaker (e.g., speaker 110R) according to the right output channel $O_R$ arrived at the right ear can cancel a wavefront of a contralateral sound component output by a right speaker (e.g., speaker 110L) according to the left output channel $O_L$. Similarly, a wavefront of an ipsilateral sound component output by the left speaker according to the left output channel $O_L$ arrived at the left ear can cancel a wavefront of a contralateral sound component output by the right speaker according to right output channel $O_R$. Thus, contralateral sound components can be reduced to enhance spatial detectability.

Example Audio Signal Enhancement Process

Figure 5:
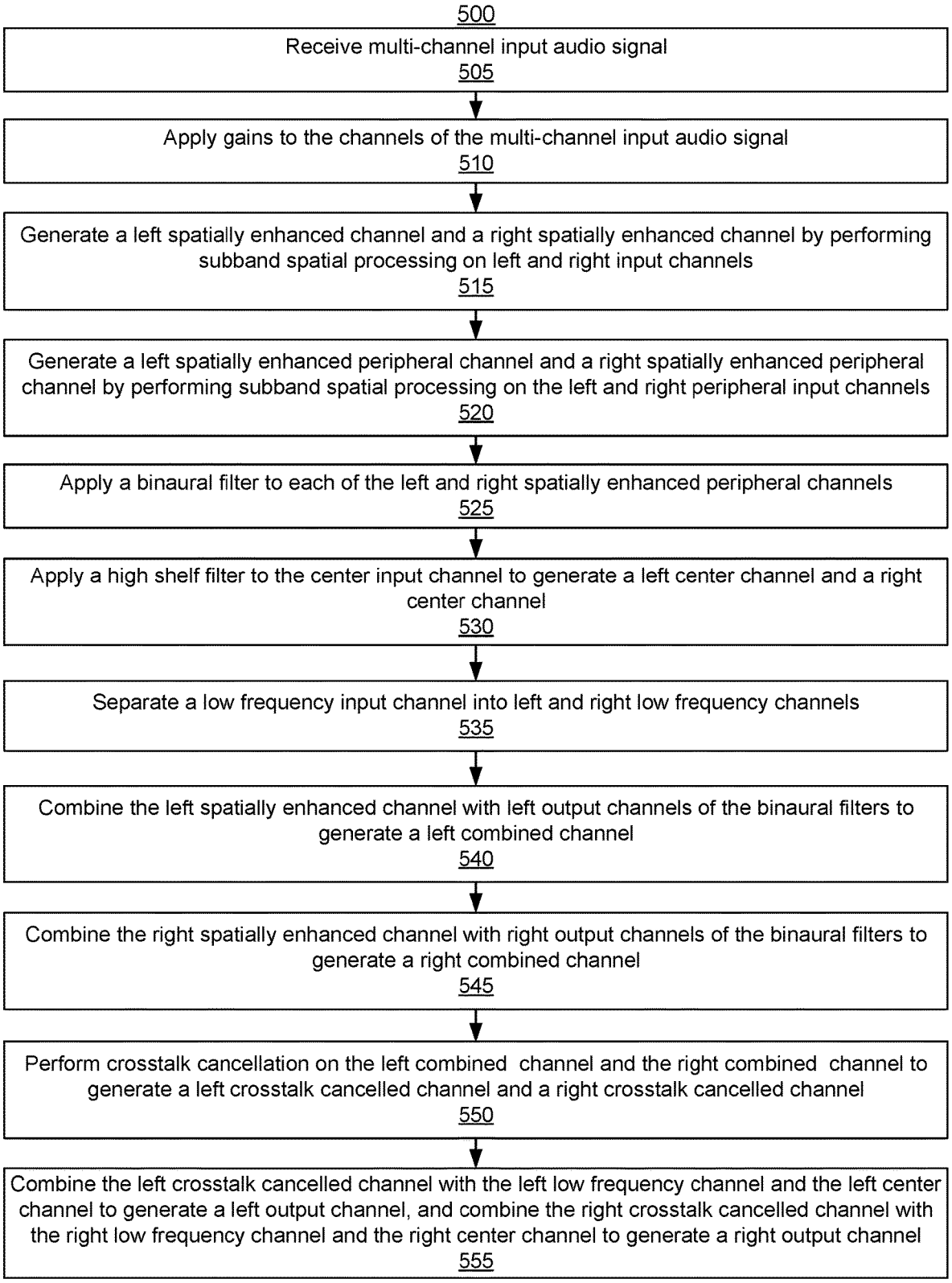
FIG. 5 illustrates an example of a method for enhancing an audio signal with the audio system shown in FIG. 2, according to one embodiment.

FIG. 5 illustrates an example of a method 500 for enhancing an audio signal with the audio system 200 shown in FIG. 2, according to one embodiment. In some embodiments, the method 500 may include different and/or additional steps, or some steps may be in different orders.

The audio system 200 receives 505 a multi-channel input audio signal. The multi-channel audio signal may be a surround sound audio signal including a left input channel, a right input channel, at least one left peripheral input channel, and at least one right peripheral input channel. The multi-channel audio signal may further include the center input channel 210C and the low frequency input channel 210D. For example, the input audio signal may be for a 7.1 surround sound system including the left input channel 210A and the right input channel 210B, and peripheral channels including the left surround input channel 210E and the right surround input channel 210F, and the left surround rear input channel 210G, and the right surround rear input channel 210H. In another example of an input audio signal for a 5.1 surround sound system, the peripheral channels may include a single left peripheral channel and a single right peripheral channel.

The audio system 200 (e.g., gains 215A through 215H) applies 510 gains to the channels of the multi-channel input audio signal. The gains 215A through 215H may vary to control the contribution of particular input channels to the output signal generated by the audio system 200. In some embodiments, the center channel 210C receives a negative gain while the peripheral input channels receive a positive gain.

The audio system 200 (e.g., subband spatial processor 230A) generates 515 a left spatially enhanced channel and a right spatially enhanced channel by performing subband spatial processing on the left input channel and the right input channel. For example, the subband spatial processor 230A generates the spatially enhanced channels by adjusting gains of n subbands of the mid component and the side component of the left input channel 210A and the right input channel 210B.

The audio system 200 (e.g., subband spatial processor 230B and/or 230C) generates 520 a left spatially enhanced peripheral channel and a right spatially enhanced peripheral channel by performing subband spatial processing on the left peripheral input channel and the right peripheral input channel. For example, the subband spatial processor 230B adjusts gains of n subbands of the mid component and the side component of the left surround channel 210E and the right surround channel 210F to generate left and right spatially enhanced peripheral channels. The subband spatial processor 230C adjusts gains of the n subband of the mid component and the side component of the left surround rear channel 210G and the right surround rear channel 210H to generate left and right spatially enhanced peripheral channels.

The audio system 200 (e.g., binaural filters 250A through 250D) applies 525 a binaural filter to each of the left and right spatially enhanced peripheral channels. For example, the binaural filter 250A generates a left and right output channel from the left spatially enhanced peripheral channel output from the subband spatial processor 230B by applying a head-related transfer function (HRTF). The binaural filter 250B generates a left and right output channel from the spatially enhanced right channel output from the subband spatial processor 230B by applying a HRTF. The binaural filter 250C generates a left and right output channel from the spatially enhanced left channel output from the subband spatial processor 230C by applying a HRTF. The binaural filter 250D generates a left and right output channel from the spatially enhanced right channel output from the subband spatial processor 230C by applying a HRTF. In some embodiments, the binaural filtering is bypassed.

The audio system 200 (e.g., high shelf filter 220) applies 530 a high shelf filter to the center input channel 210C. In some embodiments, a gain is applied to the center input channel 210C. Furthermore, the high shelf filter 220 separates the center input channel 210C into a left center channel and a right center channel.

The audio system 200 (e.g., divider 240) separates 535 the low frequency input channel into left and right low frequency channels.

The audio system 200 (e.g., left channel combiner 260A) combines 540 the left spatially enhanced channel from the subband subband spatial processor 230A and the left output channels of the binaural filters 250A, 250B, 250C, and 250D to generate a left combined channel. For example, the left spatially enhanced channel may be added with the left output channels.

The audio system 200 (e.g., right channel combiner 260B) combines 545 the right spatially enhanced channel from the subband subband spatial processor 230A and the right output channels of the binaural filters 250A, 250B, 250C, and 250D to generate a right combined channel. For example, the right spatially enhanced channel may be added with the right output channels.

The audio system 200 (e.g., crosstalk cancellation processor 270) performs 550 a crosstalk cancellation on the left combined channel and the right combined channel to generate a left crosstalk cancelled channel and a right crosstalk cancelled channel.

The audio system 200 (e.g., left channel combiner 260C and right channel combiner 260D) combines 555 the left crosstalk cancelled channel from the crosstalk cancellation processor 270 with the left low frequency channel from the divider 240 and the left center channel from the high shelf filter 220 to generate a left output channel, and combines the right crosstalk cancelled channel from the crosstalk cancellation processor 270 with the right low frequency channel from the divider 240 and the right center channel from the high shelf filter 220 to generate a right output channel. Furthermore, the audio system 200 (e.g., output gain 280) may apply gains to each of the left and right output channels. The audio system 200 outputs an output audio signal including the left and right output channels 290L and 290R.

Example Audio System and Example Audio Processing Process

Figure 6:
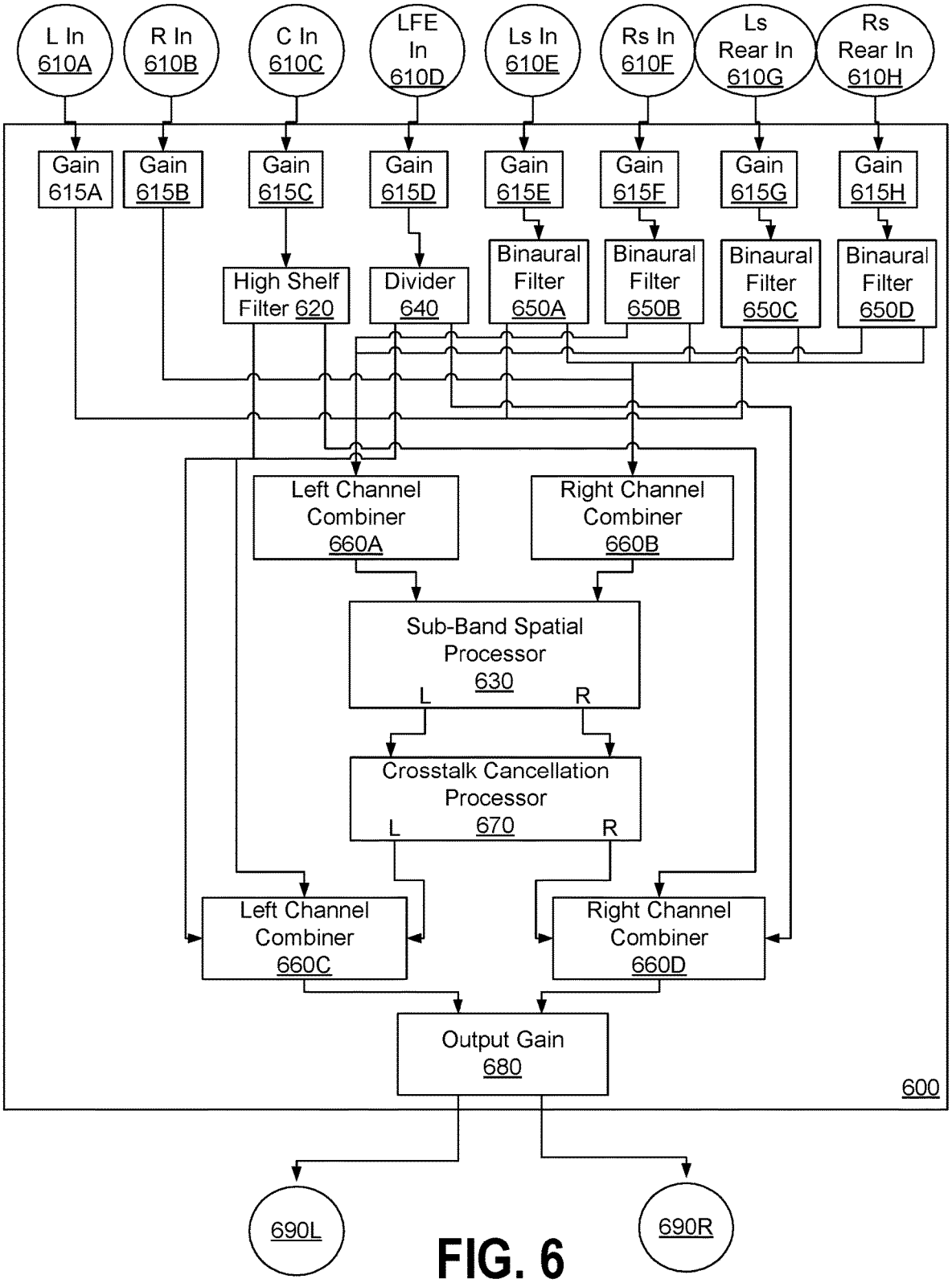
FIG. 6 illustrates an example of an audio system, according to one embodiment.

FIG. 6 illustrates an example of an audio system 600, according to one embodiment. The audio system 600 may be similar to the audio system 200, but may differ from the audio system 200 at least in that the left and right input channels are combined with the left and right peripheral channels prior to subband spatial processing for the audio system 600. Here, a single subband spatial processor and corresponding subband spatial processing step may be used rather than separate subband spatial processors for left-right speaker pairs as shown for the audio system 200.

The audio system 600 receives an input audio signal. The input audio signal may include a left input channel 610A, a right input channel 610B, a center input channel 610C, a low frequency input channel 610D, a left surround input channel 610E, a right surround input channel 610F, a left surround rear input channel 610G, and a right surround rear input channel 610H. The channels 610E, 610F, 610G, and 610H are examples of peripheral channels that may be provided to surround speakers. In some embodiments, the audio system 600 may receive and process an input audio signal having fewer or more channels.

The audio system 600 generates an output signal including a left output channel 690L and a right output channel 690R using enhancements such as subband spatial processing and crosstalk cancellation on the input audio signal. The left output channel 690L may be provided to a left speaker and the right output channel 690R may be output to a right speaker. The output audio signal provides a spatial sense of the sound field associated with the surround sound input audio signal using left and right speakers (e.g., left speaker 110L and right speaker 110R).

The audio system 600 includes gains 615A, 615B, 615C, 615D, 615E, 615F, 615G, and 615H, a high shelf filter 620, a divider 640, binaural filters 650A, 650B, 650C, and 650D, a left channel combiner 660A, a right channel combiner 660B, a sub-band spatial processor 630, a crosstalk cancellation processor 670, a left channel combiner 660C, a right channel combiner 660D, and an output gain 680.

Each of the gains 615A through 615H may receive a respective input channel 610A through 610H, and may apply a gain to an input channel 610A through 610H. The gains 615A through 615H may be different to adjust gains of the input channels with respect to each other, or may be the same. In some embodiments, positive gains are applied to the left and right peripheral input channels 610E, 610F, 610G, and 610H, and a negative gain is applied to the center channel 610C. For example, the gain 615A may apply a 0 db gain, the gain 615B may apply a 0 dB gain, the gain 615C may apply a −3 dB gain, the gain 615D may apply a 0 db gain, the gain 615E may apply a 3 dB gain, the gain 615F may apply a 3 dB gain, the gain 615G may apply a 3 dB gain, and the gain 615H may apply a 3 dB gain.

The gain 615A for the left input channel 610A is coupled to the left channel combiner 660A. The gain 615B for the right input channel 610B is coupled to the right channel combiner 660B. The gain 615C is coupled to the high shelf filter 620. The gain 615D is coupled to the divider 640. The gains 615E, 615F, 610G, and 610H of the peripheral input channels are each coupled to a binaural filter 650. In particular, the gain 610E is coupled to the binaural filter 650A, the gain 615F is coupled to the binaural filter 650B, the gain 615G is coupled to the binaural filter 650C, and the gain 615H is coupled to the binaural filter 650D.

Each of the binuaral filters 650A, 650B, 650C, and 650D apply a head-related transfer function (HRTF) that describes the target source location from which the listener should perceive the sound of the input channel. Each binaural filter receives an input channel and generates a left and right output channel by applying the HRTF. The discussion of the binaural filters 250A, 250B, 250C, and 250D of the audio system 200 may be applicable to the binaural filters 650A, 650B, 650C, and 650D. For example, each of the binaural filters 650A through 650D may apply an adjustment for the angular positions associated with their respective input channel. In some embodiments, one or more of the binaural filters 650A through 650D may be bypassed, or omitted from the audio system 600.

The left channel combiner 660A is coupled to the gain 615A and the binaural filters 650A through 650D. The left channel combiner 660A receives the left output channels of the binaural filters 650A through 650D, and combines the left output channels with the output of the gain 615A. The right channel combiner 660B is coupled to the gain 615B and the binaural filters 650A through 650D. The right channel combiner 660B receives the right output channels of the binaural filters 650A through 650D, and combines the right output channels with the output of the gain 615B.

In some embodiments, the binaural filtering is performed subsequent to subband spatial processing. For example, a binaural filter may be applied to the left and right outputs of the subband spatial processor 630 as suitable to adjust for angular positions associated with the channels. In some embodiments, binaural filters are applied to the peripheral input channels as shown in FIG. 6. In some embodiments, binaural filters are applied to the center input channel 610C or the low frequency input channel 610D. In some embodiments, binaural filters are applied to each input channel except the low frequency input channel 610D.

The subband spatial processor 630 performs subband spatial processing on a left and right input channel by gain adjusting mid and side subband components of the left and right input channels to generate left and right spatially enhanced channels as output. The subband spatial processor 630 is coupled to the left channel combiner 660A to receive a left combined channel from the left channel combiner 660A and is coupled to the right channel combiner 660B to receive a right combined channel from the right channel combiner 660B. Unlike the subband spatial processors 230A, 230B, and 230C of the audio system 200 that each processes a corresponding left and right input channel, the subband spatial processor 630 processes the left and right channels after combination into the left and right combined channels. Thus, the audio system 600 may include only a single subband spatial processor 630. In some embodiments, the subband spatial processor 230 shown in FIG. 3 is an example of the subband spatial processor 630.

The crosstalk cancellation processor 670 performs crosstalk cancellation on the output of the subband spatial processor 630, which may represent a mixed down stereo signal of the input audio signal. The crosstalk cancellation processor 670 receives left and right input channels from the subband spatial processor 630, and performs a crosstalk cancellation to generate left and right crosstalk cancelled channels. The crosstalk cancellation processor 670 is coupled to the left channel combiner 260A and the right channel combiner 260B. In some embodiments, the crosstalk cancellation processor 270 shown in FIG. 4 is an example of the crosstalk cancellation processor 670.

The high shelf filter 620 receives the center input channel 610C and applies a high frequency shelving or peaking filter. The high shelf filter 620 provides a "voice-lift" on the center input channel 610C. In some embodiments, the high shelf filter 620 is bypassed, or omitted from the audio system 600. The high shelf filter 620 may attenuate frequencies above a corner frequency. The high shelf filter 620 is coupled to the left channel combiner 660C and the right channel combiner 660D. In some embodiments, the high shelf filter 620 is defined by a 750 Hz corner frequency, a +3 dB gain, and 0.8 Q factor. The high shelf filter 620 generates a left center channel and a right center channel as output.

The divider 640 receives the low frequency input channel 610D, and separates the low frequency input channel 610D into left and right low frequency channels. The divider 640 is coupled to the left channel combiner 660C and the right channel combiner 660D, and provides the left low frequency channel to the left channel combiner 660C and the right low frequency channel to the right channel combiner 660D.

The left channel combiner 660C is coupled to the crosstalk cancellation processor 670, the high shelf filter 620, and the divider 640. The left channel combiner 660C receives the left crosstalk channel from the crosstalk cancellation processor 670, the left center channel from the high shelf filter 620, and the left low frequency channel from the divider 640, and combines these channels into a left output channel.

Right channel combiner 660D is coupled to the crosstalk cancellation processor 670, the high shelf filter 620, and the divider 640. The right channel combiner 660D receives the right crosstalk channel from the crosstalk cancellation processor 670, the right center channel from the high shelf filter 620, and the right low frequency channel from the divider 640, and combines these channels into a right output channel.

In some embodiments, the left center channel from the high shelf filter 620 and the left low frequency channel from the divider 640 are combined by the left channel combiner 660A with the left output channels of the binaural filters 650A through 650D and the output of the gain 615A to generate a left combined channel. The right center channel from the high shelf filter 620 and the right low frequency channel from the divider 640 are combined by the right channel combiner 660B with the right output channels of the binaural filters 650A through 650D and the output of the gain 615B to generate a right combined channel. The left and right combined channels are input into the subband spatial processor 630 and the crosstalk cancellation processor 670. Here, the center and low frequency channels receive the subband spatial processing and crosstalk cancellation operations. The left channel combiner 660C and right channel combiner 660D may be omitted. In some embodiments, one of the center or low frequency channels receives the subband spatial processing and crosstalk cancellation operations.

The output gain 680 is coupled to left channel combiner 660C and the right channel combiner 660D. The output gain 680 applies a gain to the left output channel from the left channel combiner 660C, and applies a gain to the right output channel from the right channel combiner 660D. The output gain 680 may apply the same gain to the left and right output channels, or may apply different gains. The output gain 680 outputs the left output channel 690L and the right output channel 690R which represent the channels of the output signal of the audio system 600.

Figure 7:
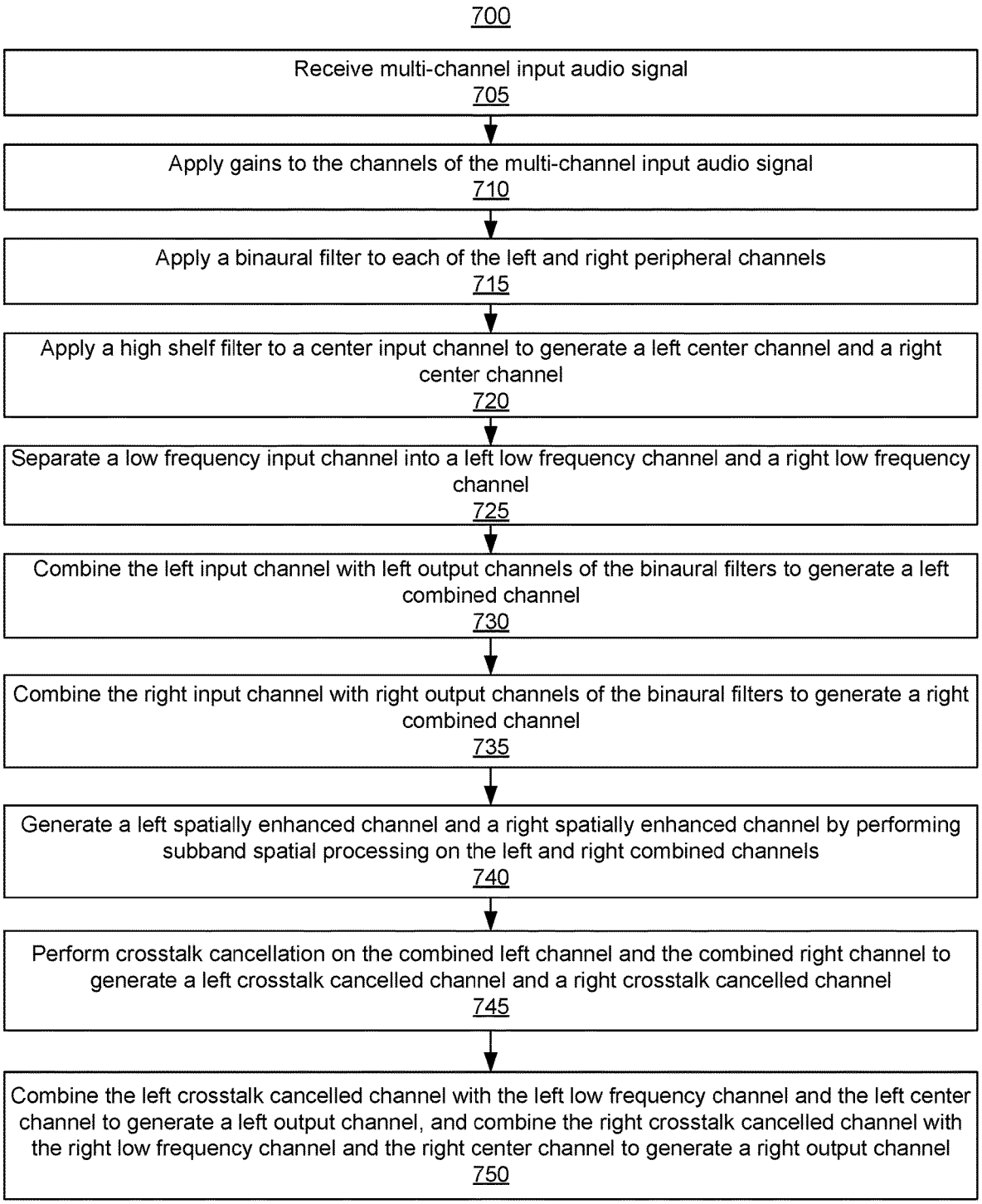
FIG. 7 illustrates an example of a method for enhancing an audio signal with the audio system shown in FIG. 6, according to one embodiment.

FIG. 7 illustrates an example of a method 700 for enhancing an audio signal with the audio system 600 shown in FIG. 6, according to one embodiment. In some embodiments, the method 700 may include different and/or additional steps, or some steps may be in different orders.

The audio system 600 receives 705 a multi-channel input audio signal. The input audio signal may include a left input channel 610A, a right input channel 610B, at least one left peripheral input channel, and at least one right peripheral input channel. The multi-channel audio signal may further include the center input channel 610C and the low frequency input channel 610D.

The audio system 600 (e.g., gains 615A through 615H) applies 710 gains to the channels of the multi-channel input audio signal. The gains 615A through 615H may vary to control the contribution of particular input channels to the output signal generated by the audio system 600.

The audio system 600 (e.g., binaural filters 650A through 650D) applies 715 a binaural filter to each of the left and right peripheral channels. For example, the binaural filter 650A generates a left and right output channel from the left surround input channel 610E by applying a head-related transfer function (HRTF). The binaural filter 650B generates a left and right output channel from the right surround input channel 610F by applying a HRTF. The binaural filter 650C generates a left and right output channel from the left surround rear input channel 610G by applying a HRTF. The binaural filter 650D generates a left and right output channel from the right surround rear input channel 610H by applying a HRTF.

The audio system 600 (e.g., high shelf filter 620) applies 720 a high shelf filter to the center input channel 610C. In some embodiments, a gain is applied to the center input channel 610C. Furthermore, the high shelf filter 620 separates the center input channel 610C into a left center channel and a right center channel.

The audio system 600 (e.g., divider 640) separates 725 the low frequency input channel into left and right low frequency channels.

The audio system 600 (e.g., left channel combiner 660A) combines 730 the left input channel 610A and the left output channels of the binaural filters 650A, 650B, 650C, and 650D to generate a left combined channel.

The audio system 600 (e.g., right channel combiner 660B) combines 735 the right input channel 610B and the right output channels of the binaural filters 650A, 650B, 650C, and 650D, to generate a right combined channel.

The audio system 600 (e.g., subband spatial processor 630) generates 740 a left spatially enhanced channel and a right spatially enhanced channel by performing subband spatial processing on the left combined channel and the right combined channel. For example, the subband spatial processor 630 receives the left and right combined channels from the left channel combiner 660A and the right channel combiner 660B, and generates the spatially enhanced channels by adjusting gains of n subbands of the mid component and the side component of the left and right combined channels.

The audio system 600 (e.g., crosstalk cancellation processor 670) performs 745 a crosstalk cancellation on the left and right spatially enhanced channels from the subband spatial processor 630 to generate a left crosstalk cancelled channel and a right crosstalk cancelled channel.

The audio system 600 (e.g., left channel combiner 660C and right channel combiner 660D) combines 750 the left crosstalk cancelled channel from the crosstalk cancellation processor 670 with the left low frequency channel from the divider 640 and the left center channel from the high shelf filter 620 to generate a left output channel, and combines the right crosstalk cancelled channel from the crosstalk cancellation processor 670 with the right low frequency channel from the divider 640 and the right center channel from the high shelf filter 620 to generate a right output channel. Furthermore, the audio system 600 (e.g., output gain 680) may apply gains to each of the left and right output channels. The audio system 600 outputs an output audio signal including the left and right output channels 690L and 690R.

It is noted that the systems and processes described herein may be embodied in an embedded electronic circuit or electronic system. The systems and processes also may be embodied in a computing system that includes one or more processing systems (e.g., a digital signal processor) and a memory (e.g., programmed read only memory or programmable solid state memory), or some other circuitry such as an application specific integrated circuit (ASIC) or field-programmable gate array (FPGA) circuit.

Figure 8:
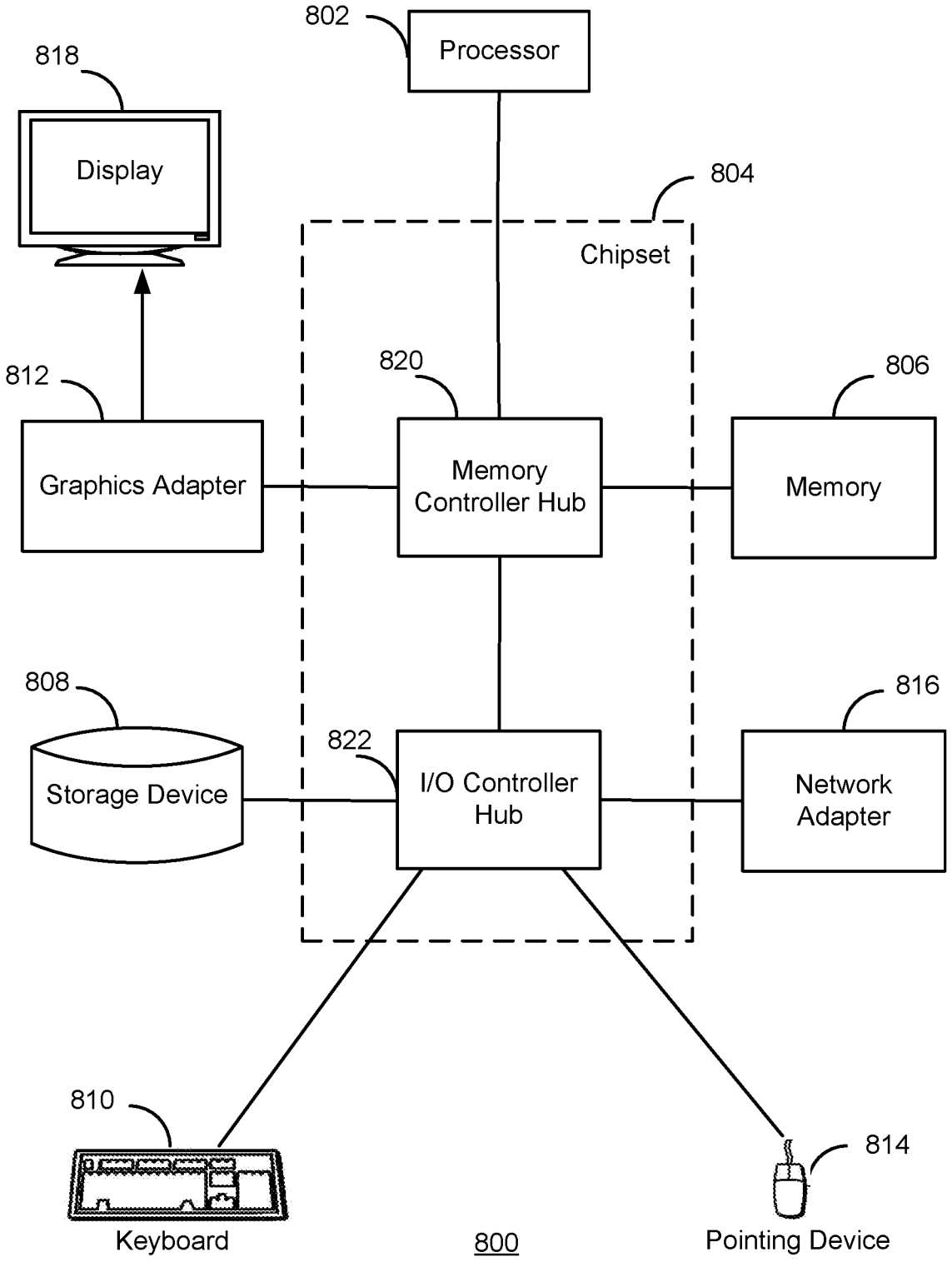
FIG. 8 illustrates an example of a computer system, according to one embodiment.

FIG. 8 illustrates an example of a computer system 800, according to one embodiment. The audio systems 200 and 600 may be implemented on the system 800. Illustrated are at least one processor 802 coupled to a chipset 804. The chipset 804 includes a memory controller hub 820 and an input/output (I/O) controller hub 822. A memory 806 and a graphics adapter 812 are coupled to the memory controller hub 820, and a display device 818 is coupled to the graphics adapter 812. A storage device 808, keyboard 810, pointing device 814, and network adapter 816 are coupled to the I/O controller hub 822. Other embodiments of the computer 800 have different architectures. For example, the memory 806 is directly coupled to the processor 802 in some embodiments.

The storage device 808 includes one or more non-transitory computer-readable storage media such as a hard drive, compact disk read-only memory (CD-ROM), DVD, or a solid-state memory device. The memory 806 holds instructions and data used by the processor 802. For example, the memory 806 may store instructions that when executed by the processor 802 causes or configures the processor 802 to perform the methods discussed herein, such as the method 500 or 700. The pointing device 814 is used in combination with the keyboard 810 to input data into the computer system 800. The graphics adapter 812 displays images and other information on the display device 818. In some embodiments, the display device 818 includes a touch screen capability for receiving user input and selections. The network adapter 816 couples the computer system 800 to a network. Some embodiments of the computer 800 have different and/or other components than those shown in FIG. 8. For example, the computer system 800 may be a server that lacks a display device, keyboard, and other components.

The computer 800 is adapted to execute computer program modules for providing functionality described herein. As used herein, the term "module" refers to computer program instructions and/or other logic used to provide the specified functionality. Thus, a module can be implemented in hardware, firmware, and/or software. In one embodiment, program modules formed of executable computer program instructions are stored on the storage device 808, loaded into the memory 806, and executed by the processor 802.

ADDITIONAL CONSIDERATIONS

The disclosed configuration may include a number of benefits and/or advantages. For example, a multi-channel input signal can be output to stereo loudspeakers while preserving or enhancing a spatial sense of the sound field. A high quality listening experience can be achieved without requiring expensive multi-speaker sound systems, such as on mobile devices, sound bars, or smart speakers.

Upon reading this disclosure, those of skill in the art will appreciate still additional alternative embodiments the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the scope described herein.

Any of the steps, operations, or processes described herein may be performed or implemented with one or more hardware or software modules, alone or in combination with other devices. In one embodiment, a software module is implemented with a computer program product comprising a computer readable medium (e.g., non-transitory computer readable medium) containing computer program code, which can be executed by a computer processor for performing any or all of the steps, operations, or processes described.

The invention claimed is:

1. A system for processing a multi-channel input audio signal, comprising:

circuitry configured to:

receive the multi-channel input audio signal including a left input channel, a right input channel, a left peripheral input channel, and a right peripheral input channel;

perform subband spatial processing on the left input channel, the right input channel, the left peripheral input channel, and the right peripheral input channel to create spatially enhanced channels, the subband spatial processing including gain adjusting mid subband components and side subband components of the left input channel, the right input channel, the left peripheral input channel, and the right peripheral input channel;

perform crosstalk cancellation on the spatially enhanced channels to create a left crosstalk cancelled channel and a right crosstalk cancelled channel; and generate a left output channel from the left crosstalk cancelled channel and a right output channel from the right crosstalk cancelled channel.

2. The system of claim 1, wherein the circuitry configured to perform the subband spatial processing includes the circuitry being configured to:

gain adjust the mid subband components and the side subband components of the left input channel and the right input channel;

gain adjust the mid subband components and the side subband components of the left peripheral input channel and the right peripheral input channel; and combine the gain adjusted mid subband components and the gain adjusted side subband components of the left input channel, the right input channel, the left peripheral input channel, and the right peripheral input channel into a left combined channel and a right combined channel.

3. The system of claim 2, wherein the circuitry is further configured to:

apply a first binaural filter to the left peripheral input channel subsequent to gain adjusting the mid subband components and the side subband components of the left peripheral input channel, the first binaural filter adjusting for an angular position associated with the left peripheral input channel; and apply a second binaural filter to the right peripheral input channel subsequent to gain adjusting the mid subband components and the side subband components of the right peripheral input channel, the second binaural filter adjusting for an angular position associated with the right peripheral input channel.

4. The system of claim 2, wherein the circuitry is further configured to:

apply a first binaural filter to the left peripheral input channel prior to gain adjusting the mid subband components and the side subband components of the left peripheral input channel, the first binaural filter adjusting for an angular position associated with the left peripheral input channel; and apply a second binaural filter to the right peripheral input channel prior to gain adjusting the mid subband components and the side subband components of the right peripheral input channel, the second binaural filter adjusting for an angular position associated with the right peripheral input channel.

5. The system of claim 2, wherein the circuitry configured to perform the crosstalk cancellation includes the circuitry being configured to:

separate the left combined channel into a left inband signal and a left out-of-band signal;

separate the right combined channel into a right inband signal and a right out-of-band signal;

generate a left crosstalk cancellation component by filtering and time delaying the left inband signal;

generate a right crosstalk cancellation component by filtering and time delaying the right inband signal;

generate the left crosstalk cancelled channel by combining the right crosstalk cancellation component with the left inband signal and the left out-of-band signal; and generate the right crosstalk cancelled channel by combining the left crosstalk cancellation component with the right inband signal and the right out-of-band signal.

6. The system of claim 1, wherein the circuitry configured to perform the subband spatial processing includes the circuitry being configured to:

combine the left input channel and the left peripheral input channel into a left combined channel;

combine the right input channel and the right peripheral input channel into a right combined channel; and gain adjust mid subband components and side subband components of the left combined channel and the right combined channel to create a left spatially enhanced channel and a right spatially enhanced channel.

7. The system of claim 6, wherein the circuitry is further configured to:

apply a first binaural filter to the left peripheral input channel prior to combining the left peripheral input channel with the left input channel, the first binaural filter adjusting for an angular position associated with the left peripheral input channel; and apply a second binaural filter to the right peripheral input channel prior to combining the right peripheral input channel with the right input channel, the second binaural filter adjusting for an angular position associated with the right peripheral input channel.

8. The system of claim 6, wherein the circuitry configured to perform the crosstalk cancellation includes the circuitry being configured to:

separate the left spatially enhanced channel into a left inband signal and a left out-of-band signal;

separate the right spatially enhanced channel into a right inband signal and a right out-of-band signal;

generate a left crosstalk cancellation component by filtering and time delaying the left inband signal;

generate a right crosstalk cancellation component by filtering and time delaying the right inband signal;

generate the left crosstalk cancelled channel by combining the right crosstalk cancellation component with the left inband signal and the left out-of-band signal; and generate the right crosstalk cancelled channel by combining the left crosstalk cancellation component with the right inband signal and the right out-of-band signal.

9. The system of claim 1, wherein the left peripheral input channel is a left surround input channel of the multi-channel input audio signal, and the right peripheral input channel is a right surround input channel of the multi-channel input audio signal.

10. The system of claim 1, wherein the left peripheral input channel is a left surround rear input channel of the multi-channel input audio signal, and the right peripheral input channel is a right surround rear input channel of the multi-channel input audio signal.

11. The system of claim 1, wherein the circuitry is further configured to combine a center channel and a low frequency channel of the multi-channel input audio signal with the left crosstalk cancelled channel and the right crosstalk cancelled channel.

12. The system of claim 11, wherein the circuitry is further configured to apply a binaural filter to each of the left input channel, the right input channel, the left peripheral input channel, the right peripheral input channel, and the center channel.

13. The system of claim 11, wherein the circuitry is further configured to apply a high shelf filter to the center channel prior to combining the center channel with the left crosstalk cancelled channel and the right crosstalk cancelled channel.

14. The system of claim 1, wherein the circuitry is further configured to:

combine at least one of a center channel and a low frequency channel with the spatially enhanced channels to generate combined channels; and perform the crosstalk cancellation on the combined channels.

15. The system of claim 1, wherein the circuitry is further configured to:

combine at least one of a center channel and a low frequency channel with the left input channel, the right input channel, the left peripheral input channel, and the right peripheral input channel to generate combined channels; and perform the subband spatial processing and the crosstalk cancellation on the combined channels.

16. A non-transitory computer readable medium storing program code that when executed by a processor causes the processor to:

receive a multi-channel input audio signal including a left input channel, a right input channel, a left peripheral input channel, and a right peripheral input channel;

perform subband spatial processing on the left input channel, the right input channel, the left peripheral input channel, and the right peripheral input channel to create spatially enhanced channels, the subband spatial processing including gain adjusting mid subband components and side subband components of the left input channel, the right input channel, the left peripheral input channel, and the right peripheral input channel;

perform crosstalk cancellation on the spatially enhanced channels to create a left crosstalk cancelled channel and a right crosstalk cancelled channel; and generate a left output channel from the left crosstalk cancelled channel and a right output channel from the right crosstalk cancelled channel.

17. The computer readable medium of claim 16, wherein the program code that causes the processor to perform subband spatial processing on the left input channel, the right input channel, the left peripheral input channel, and the right peripheral input channel includes the program code causing the processor to:

gain adjust the mid subband components and the side subband components of the left input channel and the right input channel;

gain adjust the mid subband components and the side subband components of the left peripheral input channel and the right peripheral input channel; and combine the gain adjusted mid subband components and the gain adjusted side subband components of the left input channel, the right input channel, the left peripheral input channel, and the right peripheral input channel into a left combined channel and a right combined channel.

18. The computer readable medium of claim 17, wherein the program code further causes the processor to:

apply a first binaural filter to the left peripheral input channel subsequent to gain adjusting the mid subband components and the side subband components of the left peripheral input channel, the first binaural filter adjusting for an angular position associated with the left peripheral input channel; and apply a second binaural filter to the right peripheral input channel subsequent to gain adjusting the mid subband components and the side subband components of the right peripheral input channel, the second binaural filter adjusting for an angular position associated with the right peripheral input channel.

19. The computer readable medium of claim 17, wherein the program code further causes the processor to:

apply a first binaural filter to the left peripheral input channel prior to gain adjusting the mid subband components and the side subband components of the left peripheral input channel, the first binaural filter adjusting for an angular position associated with the left peripheral input channel; and apply a second binaural filter to the right peripheral input channel prior to gain adjusting the mid subband components and the side subband components of the right peripheral input channel, the second binaural filter adjusting for an angular position associated with the right peripheral input channel.

20. The computer readable medium of claim 17, wherein the program code that causes the processor to perform the crosstalk cancellation includes the program code causing the processor to:

separate the left combined channel into a left inband signal and a left out-of-band signal;

separate the right combined channel into a right inband signal and a right out-of-band signal;

generate a left crosstalk cancellation component by filtering and time delaying the left inband signal;

generate a right crosstalk cancellation component by filtering and time delaying the right inband signal;

generate the left crosstalk cancelled channel by combining the right crosstalk cancellation component with the left inband signal and the left out-of-band signal; and generate the right crosstalk cancelled channel by combining the left crosstalk cancellation component with the right inband signal and the right out-of-band signal.

21. The computer readable medium of claim 16, wherein the program code that causes the processor to perform subband spatial processing on the left input channel, the right input channel, the left peripheral input channel, and the right peripheral input channel includes the program code causing the processor to:

combine the left input channel and the left peripheral input channel into a left combined channel;

combine the right input channel and the right peripheral input channel into a right combined channel; and gain adjust mid subband components and side subband components of the left combined channel and the right combined channel to create a left spatially enhanced channel and a right spatially enhanced channel.

22. The computer readable medium of claim 21, wherein the program code further causes the processor to:

apply a first binaural filter to the left peripheral input channel prior to combining the left peripheral input channel with the left input channel, the first binaural filter adjusting for an angular position associated with the left peripheral input channel; and apply a second binaural filter to the right peripheral input channel prior to combining the right peripheral input channel with the right input channel, the second binaural filter adjusting for an angular position associated with the right peripheral input channel.

23. The computer readable medium of claim 21, wherein the program code that causes the processor to perform the crosstalk cancellation includes the program code causing the processor to:

separate the left spatially enhanced channel into a left inband signal and a left out-of-band signal;

separate the right spatially enhanced channel into a right inband signal and a right out-of-band signal;

generate a left crosstalk cancellation component by filtering and time delaying the left inband signal;

generate a right crosstalk cancellation component by filtering and time delaying the right inband signal;

generate the left crosstalk cancelled channel by combining the right crosstalk cancellation component with the left inband signal and the left out-of-band signal; and generate the right crosstalk cancelled channel by combining the left crosstalk cancellation component with the right inband signal and the right out-of-band signal.

24. The computer readable medium of claim 16, wherein the left peripheral input channel is a left surround input channel of the multi-channel input audio signal, and the right peripheral input channel is a right surround input channel of the multi-channel input audio signal.

25. The computer readable medium of claim 16, wherein the left peripheral input channel is a left surround rear input channel of the multi-channel input audio signal, and the right peripheral input channel is a right surround rear input channel of the multi-channel input audio signal.

26. The computer readable medium of claim 16, wherein the program code further causes the processor to combine a center channel and a low frequency channel of the multi-channel input audio signal with the left crosstalk cancelled channel and the right crosstalk cancelled channel.

27. The computer readable medium of claim 26, wherein the program code further causes the processor to apply a binaural filter to each of the left input channel, the right input channel, the left peripheral input channel, the right peripheral input channel, and the center channel.

28. The computer readable medium of claim 27, wherein the program code further causes the processor to apply a high shelf filter to the center channel prior to combining the center channel with the left crosstalk cancelled channel and the right crosstalk cancelled channel.

29. The computer readable medium of claim 16, wherein the program code further causes the processor to:

combine at least one of a center channel and a low frequency channel with the spatially enhanced channels to generate combined channels; and perform the crosstalk cancellation on the combined channels.

30. The computer readable medium of claim 16, wherein the program code further causes the processor to:

combine at least one of a center channel and a low frequency channel with the left input channel, the right input channel, the left peripheral input channel, and the right peripheral input channel to generate combined channels; and perform the subband spatial processing and the crosstalk cancellation on the combined channels.

31. A method of processing a multi-channel input audio signal, comprising:

receiving the multi-channel input audio signal including a left input channel, a right input channel, a left peripheral input channel, and a right peripheral input channel;

performing subband spatial processing on the left input channel, the right input channel, the left peripheral input channel, and the right peripheral input channel to create spatially enhanced channels, the subband spatial processing including gain adjusting mid subband components and side subband components of the left input channel, the right input channel, the left peripheral input channel, and the right peripheral input channel;

performing crosstalk cancellation on the spatially enhanced channels to create a left crosstalk cancelled channel and a right crosstalk cancelled channel; and generating a left output channel from the left crosstalk cancelled channel and a right output channel from the right crosstalk cancelled channel.

* * * * *